United States Patent [19]

Matsumoto

[11] Patent Number: 4,976,292

[45] Date of Patent: Dec. 11, 1990

[54] WEFT END TENSIONING AND DETECTING DEVICES FOR SHUTTLELESS LOOM

[75] Inventor: Hiroyasu Matsumoto, Ishikawa, Japan

[73] Assignee: Tagawa Kikai Co., Ltd., Janazawa, Japan

[21] Appl. No.: 366,736

[22] Filed: Jun. 15, 1989

[30] Foreign Application Priority Data

Jun. 27, 1988 [JP] Japan ..... 63-158449
Aug. 3, 1988 [JP] Japan ..... 63-193901

[51] Int. Cl.[5] ..... D03D 51/38
[52] U.S. Cl. ..... 139/194; 139/372; 139/370.2; 139/302
[58] Field of Search ..... 139/370.2, 194, 372, 139/377, 378, 375, 302, 376

[56] References Cited

U.S. PATENT DOCUMENTS

| | | | |
|---|---|---|---|
| 1,482,218 | 1/1924 | Brooks | 139/372 |
| 2,156,838 | 5/1939 | Brown et al. | 139/372 |
| 3,804,129 | 4/1974 | Bernath | 139/370.2 |
| 3,851,679 | 12/1974 | Titov et al. | 139/194 |
| 4,275,773 | 6/1981 | Shibata | 139/194 |

*Primary Examiner*—Andrew M. Falik
*Attorney, Agent, or Firm*—Barnes, Kisselle, Raisch, Choate, Whittemore & Hulbert

[57] ABSTRACT

A weft end treating device for a shuttleless loom comprises a yarn holding device which holds the free end of an inserted weft and tensions the weft in synchronism with the beating motion, and pushing dents for pushing the free end of the weft into the yarn holding device when the weft is beaten up. The yarn holding device is fixedly mounted on the frame of a loom at a position on the extension line of the cloth fell on the weft arriving side. The pushing dents are fixedly provided on the sley, of the loom opposite to the yarn holding device.

10 Claims, 9 Drawing Sheets

FIG. 13a
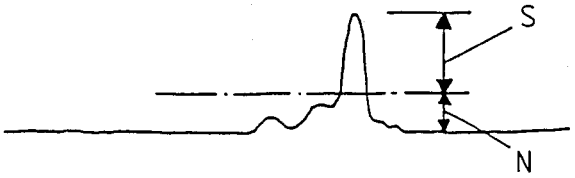
FIG. 13b
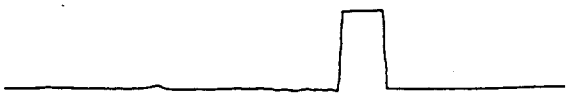
FIG. 13c
FIG. 14
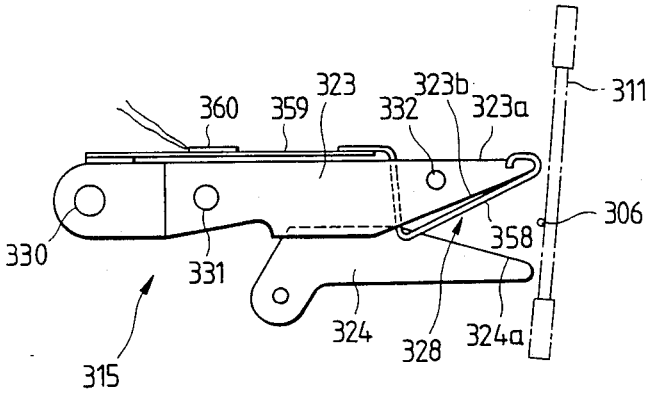
FIG. 15
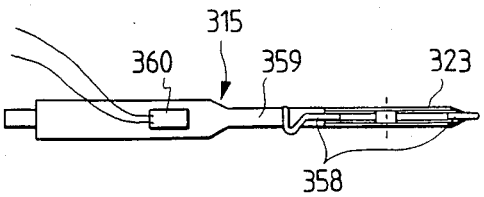

WEFT END TENSIONING AND DETECTING DEVICES FOR SHUTTLELESS LOOM

FIELD OF THE INVENTION

The present invention relates to a weft end treating device for treating the end portion of a weft on the side of the weft arriving side of a shuttleless loom, which carries out a series of functions including uniformly tensioning an inserted weft in the direction of width of the loom from the weft arriving side, maintaining the tension until the end portion of the weft is cut off, and discharging the end portion of the weft.

RELATED ART STATEMENT

In weaving a fabric on a shuttleless loom, tension distribution in an inserted weft with respect to the direction of width of the fabric immediately after the weft has been inserted is irregular because one end of the weft on the picking side is restrained while the other end of the weft is free. Since such an irregular tension distribution may cause defects in the fabric, it is desirable to hold the free end of the inserted weft and to tension the inserted weft. In cutting off an excessive free end portion of the inserted weft on the weft arriving side to form a uniform selvage, the weft must be tightened properly, otherwise the excessive free end portion cannot be cut off successfully. It is also necessary to hold the free end portion of the inserted weft continuously to remove the cut excessive free end portion (waste weft) from the loom.

In a conventional weft end treating device as shown in FIG. 18, catch cords 71 extended outside the selvage 3 catch the free end portion 6 of an inserted weft 5 on the weft arriving side, a twisting device 72 twists the catch cords 71 to tension the weft 5, and then the cut excessive end portion 7 of the weft 5 caught in the catch cords 71 is removed together with the catch cords 71 from the loom. The catch cords 71, ordinarily four to six warps, are raised and lowered alternately for shedding motion by heddles 17 and the same are twisted by a twisting device 72 to entangle the free end portion 6 of the weft therein so that the free end portion 6 is caught therein. After the free end portion 6 has been cut by a selvage cutter 14, the catch cords 71 are pulled through the twisting device 72 outside the loom. In FIG. 18, indicated at 73 are bobbins on which the catch cords 71 are wound respectively, at 11 is a reed, at 1 is a fabric, and at 74 is a belt for driving the twisting device 72.

The catch cords 71 are unable to catch the weft 5 securely before the heddles 17 complete alternate up and down motions. Accordingly, the inserted weft is tensioned from the side of the free end portion thereof after the completion of the beating motion, and hence the tension distribution in the inserted weft remains irregular during the beating motion. To solve such a problem, there have been proposed various means each employing a gripper which operates in synchronism with the beating motion of the reed to grip the free end of the weft so that the weft is uniformly tensioned. A means disclosed in Japanese Patent Publication No. 40-7231 or 46-39153 merely grips the free end of a weft to restrain the weft from becoming loose. A means disclosed in Japanese Patent Publication No. 40-7231 or Japanese Utility Model Publication No. 45-6535 employs a member provided on the reed to advance the free end of an inserted weft beyond the cloth during the beating motion to pull the free end of the weft obliquely so that the weft is tensioned. A means disclosed in Japanese Patent Publication No. 51-2995 or 50-28548 employs a gripper which operates in synchronism with the motion of the reed so as to move away from the selvage to tension the inserted weft when the reed advances for beating motion.

Japanese Patent Publication Nos. 47-20590, 50-5318 or 51-30626 discloses a further means which employs an auxiliary jet device provided on the reed at a position on the weft arriving side to tension an inserted weft by involving the free end of the weft in a jet of fluid.

The means employing the gripper to tension the weft by gripping the free end of the weft releases the free end of the weft after the reed has been retracted, and hence the means needs a further means, such as catch cords, to tension the weft for cutting off the free end of the weft and to remove the cut waste weft. When catch cords are employed, the free end of the weft must be extended by a large length from the selvage so that the free end of the weft can be caught by the catch cords and a twisting device must be provided to twist the catch cords, which increases waste weft, and requires a driving mechanism for driving the twisting device. Also, the weft is pulled unnecessarily after the weft has been woven into the fabric to cause tight picks. Also, this may cause faulty picks due to interference between the free end of the weft and the catch cords, and this causes the loom to stop due to the breakage of the catch cords.

The means employing the auxiliary jet device to tension the inserted weft by a jet of fluid requires the free end of the weft to be extended from the selvage by a large length, which is longer than the length required by the means employing the catch cords, and this requires considerable power to produce a proper jet of fluid.

A weft detector for detecting a normally inserted weft on a shuttleless loom is conventionally known.

Weft detectors for such a purpose are classified roughly into mechanical weft detectors and electrical weft detectors of a conduction type. The mechanical weft detector has a detecting needle disposed opposite the reed near the cloth fell so as to be beaten in the cloth fell by the reed. The motion of the detecting needle is detected electrically to decide whether or not a weft has normally been inserted. Ordinarily, the detecting needle is disposed at an inclination to the dents of the reed as viewed from the front and hence the detecting needle is beaten in the cloth fell even if a weft is not inserted normally. However, when a weft is not inserted normally, the detecting needle returns to the original position as the reed moves backward. Therefore, it becomes known that a weft is not inserted normally when the detecting needle returns to the original position as the reed moves backward.

The electrical weft detector of a conduction type is employed in the water-jet loom. The electrical weft detector has two electrodes disposed on the running path of a picked weft at an interval therebetween along the running path. The electrodes are connected electrically by a wet weft when the weft is inserted normally. The electrodes remain disconnected when the weft is not inserted normally.

Japanese Patent Publication No. 59-53381 proposes a electrical weft detector of a different system. This proposed electrical weft detector has a vibrator disposed on the running path of a weft and detects the presence of a weft through the electrical detection of the variation of the amplitude of vibration of the vibrator.

The mechanical weft detector requires a mechanism for pulling out the detecting needle from the fabric, and the operating speed of the mechanical weft detector is comparatively low. The mechanical weft detector is also subject to the criticism that the fabric may be flawed by the detecting needle as the detecting needle thrusts in the fabric. In addition, the detecting needle needs to be changed after a short time period because the detecting needle is exposed continuously to the intense impact of the weft and the dents thereon, and the dents corresponding to the detecting needle are liable to be damaged by the worn detecting needle.

On the other hand, the electrical weft detector is not applicable to the air-jet loom and is liable to malfunction when the electrodes are wetted or when waste yarns stick to the electrodes. Furthermore, the electrical weft detector needs a complex signal processing unit to detect a weft yarn accurately by eliminating disturbance signals because the detection signal is disturbed by the picking water jet and unsteady movement of the picked weft on the electrodes.

The electrical weft detector employing a vibrator also requires a complex signal processing operation because the detection signal has a small SN ratio. The amplitude of vibration of the vibrator is affected by the picking water jet and the movement of the reed, and it is difficult to obtain trouble-free operation because of these disturbances.

OBJECT AND SUMMARY OF THE INVENTION

It is a first object of the present invention to provide a weft end treating device capable of tensioning an inserted weft from the weft arriving side during the beating motion and capable of maintaining the inserted weft under tension until the free end of the weft is cut off.

It is another object of the present invention to provide a weft end treating device capable of removing the cut free end of the weft without any additional power and driving mechanism.

It is still another object of the present invention to provide a weft detector capable operating at a high operating speed, capable of providing a precise detection signal having a large SN ratio and including no disturbance, and capable of operating without flawing the fabric.

A weft end treating device in accordance with the present invention comprises a yarn holding device which holds the free end of an inserted weft and tensions the weft in synchronism with the beating motion, and includes pushing dents for pushing the free end of the weft into the yarn holding device when the weft is beaten up. The yarn holding device is fixedly mounted on the frame of a loom at a position on the extension line of the cloth fell on the weft arriving side. The pushing dents are fixedly provided on the sley, not shown, of the loom opposite to the yarn holding device.

The yarn holding device has upper yarn bending members and lower yarn bending members, such as thin plates or wires, arranged alternately so as to form a zigzag path for receiving the free end of the weft and so as to form a guide space for guiding the free end of the weft into the zigzag path. When pushed into the zigzag path, the free end of the weft is bent zigzag. The pushing dents advance as far as the zigzag path of the yarn holding device before the completion of the beating motion to push the free end of the weft into the zigzag path immediately after the insertion of the weft.

The weft end treating device may include a detecting element capable of entering a space between the adjacent dents of the detecting reed and disposed opposite the detecting reed on the side of the cloth fell with respect to a running path of a weft, and a sensor for electrically detecting the motion of the detecting element.

BRIEF DESCRIPTION OF DRAWINGS

FIGS. 13*a*, 13*b* and 13*c* are waveform charts showing the waveforms of signals used by the weft detector of the present invention;

FIG. 14 is a side elevation of another weft detector in a standby state;

FIG. 15 is a plane view of the weft detector of FIG. 14;

DETAILED DESCRIPTION OF PREFERRED EMBODIMENTS

Figure 1:
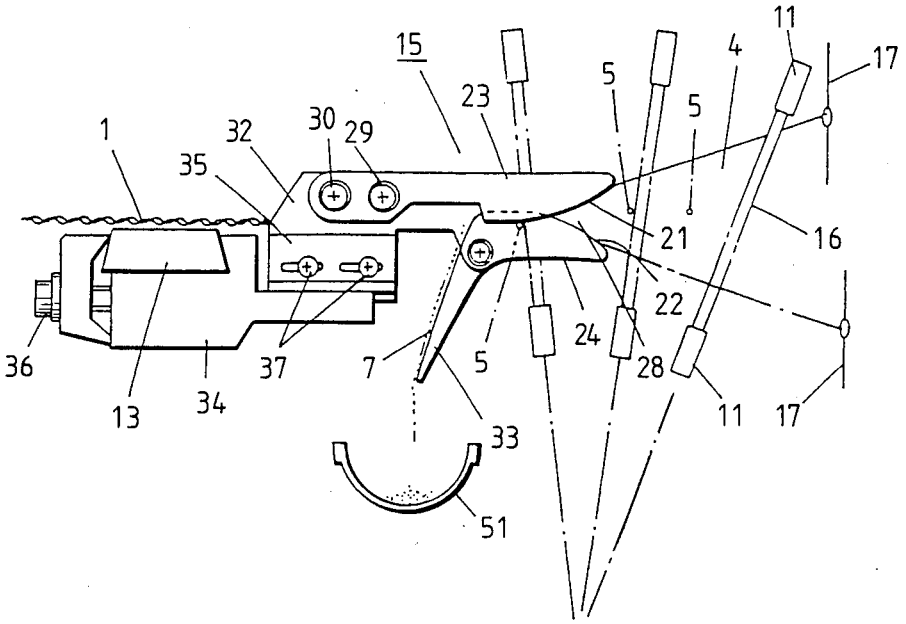
FIG. 1 is a side elevation of a weft end treating device in a first embodiment according to the present invention.
Figure 2:
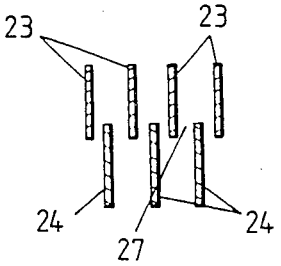
FIG. 2 is a schematic sectional view of a yarn holding device incorporated into the weft end treating device of FIG. 1.
Figure 3:
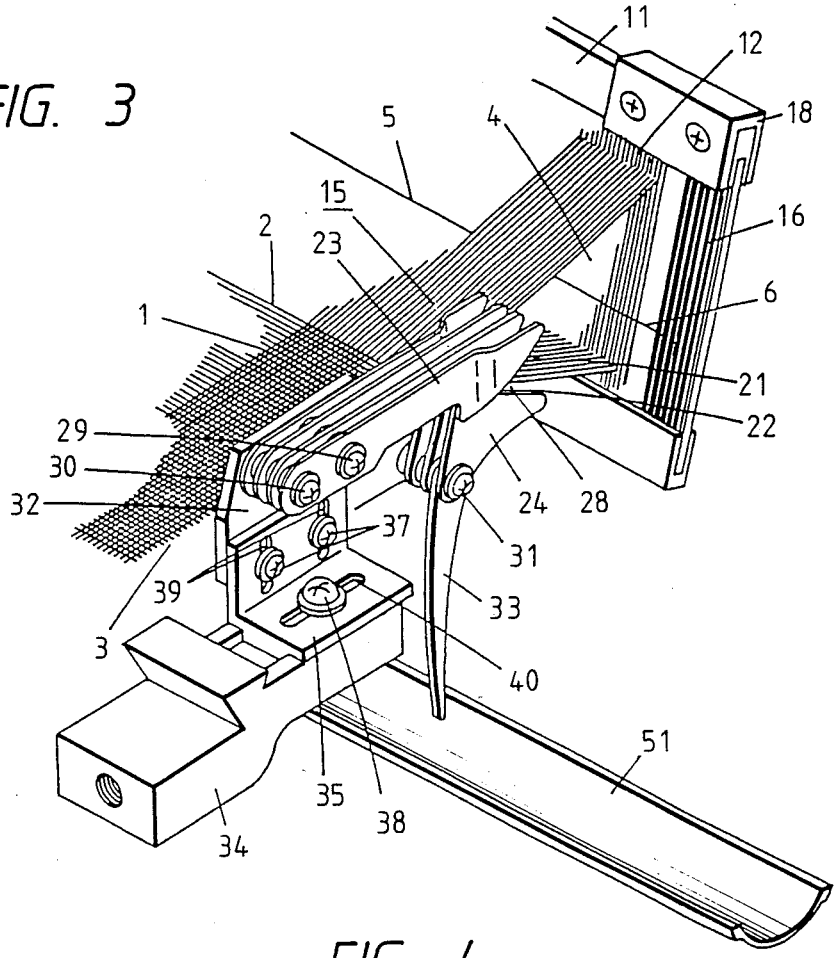
FIG. 3 is a perspective view of the weft end treating device of FIG. 1.
Figure 4:
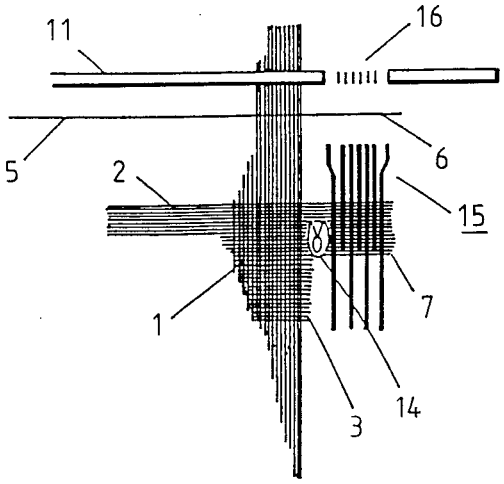
FIG. 4 is a plan view of the weft end treating device of FIG. 1.
Figure 5:
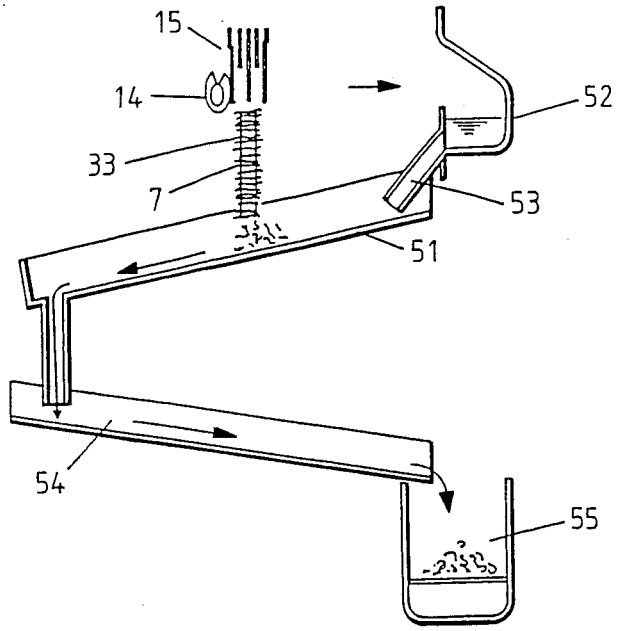
FIG. 5 is a front elevation showing a waste weft discharging path of the weft end treating device of FIG. 1.

Referring to FIGS. 1 to 5 showing a weft end treating device in a preferred embodiment according to the present invention, there are shown a fabric 1, a cloth fell 2, a selvage 3, a shed 4, a weft 5 at a position immediately after insertion, the free end 6 of the weft 5 extending on the weft arriving side of the loom, a reed 11, dents 12, a temple bar 13, a selvage cutter 14, a yarn holding device 15 incorporated into the weft end treating device of the present invention, and pushing dents 16.

The yarn holding device 15 has four upper blades 23 and three lower blades 24 to bend a weft end. Portions of the upper blades 23 and those of the lower blades 24 on the side of the reed have inclined edges 21 and 22, respectively. The upper blades 23 and the lower blades 24 are arranged alternately with the lower edge of the upper blades 23 and the upper edges of the lower blades 24 slightly overlapping each other so as to form a zigzag path 27 (FIG. 2) therebetween and to form a guide space 28 expanding from the zigzag path 27 toward the pushing dents 16.

The upper blades 23 are spaced apart from each other with spacers and are fixed to a side support plate 32 with screws 29 and 30, while the lower blades 24 are spaced apart from each other with spacers and are fixed to the side support plate 32 with a screw 31. Accordingly, the ends of the zigzag path 27 near the pushing dents 16, near the selvage 3 and remote from the selvage 3 are open. Portions of the lower blades 24 remote from the pushing dents 16 are extended downward to form discharge guide portions 33.

The support plate 32 is fixedly mounted on the temple bar 13 by a first bracket 34 and a second bracket 35. The first bracket 34 is fastened to the temple bar 13 with a screw 36. In adjusting the position of the yarn holding device 15 relative to the selvage 3, the screw 36 is unfastened to shift the first bracket 34 in the direction of width of the fabric 1 along the temple bar 13. The vertical position of the support plate 32 relative to the first bracket 34 can be adjusted by unfastening screws 37 and vertically moving the side plate 32 with respect to the second bracket 35, and the horizontal position of the support plate 32 with respect to the first bracket 34 can be adjusted by unfastening a screw 38 and horizontally moving the second bracket 35 relative to the first bracket 34. The position of the support plate 32 is adjusted so that the zigzag path 27 is positioned on the extension line of the cloth fell 2.

The pushing dents 16, six dents in this embodiment, are fixed at the respective lower ends thereof to the sley, not shown, at a position corresponding to the yarn holding device 15 and fixedly connected at the respective upper ends thereof to a reed frame 11 by a connecting member 18 having a U-shaped cross section so as to be able to enter spaces between the alternately arranged upper blades 23 and the lower blades 24, respectively.

An upper trough 51 is extended laterally at a declination below the discharge guide portions 33. A pipe 53 is extended from a water receiver 52 for receiving water jetted for picking into the upper trough 51. A lower trough 54 is extended below the upper trough 51. Water received by the water receiver 52 flows through the upper trough 51 and the lower trough 54 into a waste weft container 55.

As mentioned above with reference to the first embodiment, the free end 6 of a weft 5 is pushed by the pushing dents 16 into the zigzag path 27 of the yarn holding device 15 when the reed of the loom advances for beating motion, whereby the free end 6 of the weft 5 is bent in a zigzag shape and is held frictionally in the zigzag path 27 by the alternately arranged upper blades 23 and the lower blades 24 to tension the weft 5 being driven toward the cloth fell 2. When the free end 6 of the next weft 5 is pushed into the zigzag path 27 as the weft 5 is beaten, the preceding free end 6 of the weft 5 is shifted away from the dents 16, namely, to the front, by a distance corresponding to the diameter of the weft 5. Thus, the free ends 6 held by the yarn holding device 15 are moved sequentially to the front, are cut sequentially by the selvage cutter 14. A waste weft 7, namely, a cut portion of the free end 6 is pushed further to the front by the successive free ends 6 and is finally pushed out from the yarn holding device 15. Then, the waste weft 7 falls down along the guide portions 33 into the upper trough 51. Since the water received by the water receiver 52 flows along the upper trough 51, the waste weft 7 flows together with the water through the lower trough 54 into the waste weft container 55.

The upper trough 51 is extended in the direction of width of the fabric to move the first bracket 34 along the temple bar 13 near to the selvage when the width is changed.

Figure 6:
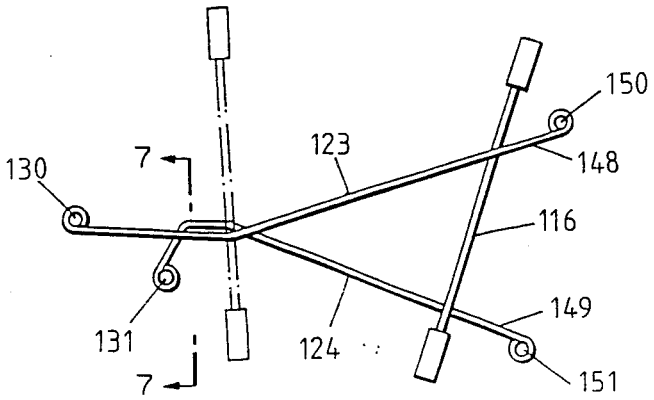
FIG. 6 is a side elevation showing an essential portion of a weft end treating device in a second embodiment according to the present invention.
Figure 7:
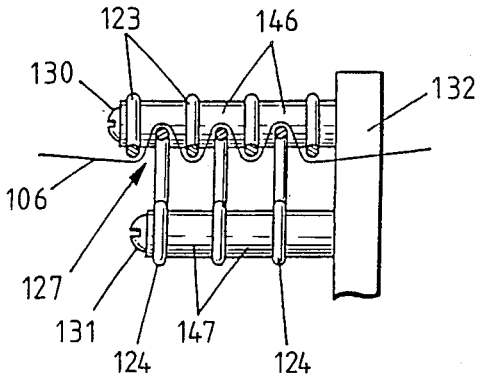
FIG. 7 is an enlarged sectional view taken on line 7—7 in FIG. 6.

A weft end treating device in a second embodiment will be described hereinafter with reference to FIGS. 6 and 7. A yarn holding device incorporated in the weft end treating device of the second embodiment employs upper wires 123 and lower wires 124 instead of the upper blades 23 and lower blades 24 of the yarn holding device 15 of the first embodiment. The upper wires 123 and the lower wires 124 are arranged alternately respectively with spacers 146 and 147 therebetween. The upper wires 123 and the lower wires 124 are extended so that one end 148 of each of the upper wires 123 and one end 149 of each of the lower wires 124 are behind the dents 116. The opposite ends of the upper wires 123 are supported respectively on screws 130 and 150, while the opposite ends of the lower wires 124 are supported respectively on screws 131 and 151. Portions of the upper wires 123 and those of the lower wires 124 corresponding to the position of the cloth fell overlap slightly each other to define a zigzag path 127 in which the free end 6 of a weft is bent in a zigzag shape. A support plate 132 supports the spacers 146 and 147.

In the weft end treating device thus constructed, the free end of an inserted weft is pushed into the zigzag path of the yarn holding device by the pushing dents simultaneously with or slightly before the completion of driving the weft to the cloth fell. Since the free end of the weft is bent in a zigzag shape in the zigzag path, the inserted weft is pulled toward the zigzag path, so that the weft is tensioned. A tension to be applied to the weft can selectively and properly be decided according to the type of the weft or the width of the fabric by selectively deciding the depth of the zigzag path or the number of the yarn bending members and forming the zigzag path.

Since the free end of the weft is retained frictionally in a zigzag shape in the zigzag path after the pushing dents are retracted, and hence the tension applied to the weft remains unchanged. The free end of the weft thus retained in the zigzag path is pushed to the front, namely, in a direction away from the reed, by the free end of the next inserted weft, and then the tight former free end is cut off from the selvage with a selvage cutter. Cut wefts (waste wefts) are pushed out sequentially from the yarn holding device by the successive free ends pushed sequentially into the zigzag path, and then the cut wefts are removed sequentially from the loom. The waste weft eliminating device is provided with a guide member to guide the cut wefts pushed out from the yarn holding device for smooth removal of the cut wefts.

As is apparent from the foregoing description, the weft end treating device in accordance with the present invention is capable of achieving a series of functions for treating a waste weft without using any catch cord or a jet of fluid and capable of reducing the length of the free end of an inserted weft to curtail the amount of waste wefts greatly as compared with the conventional weft end treating device. Furthermore, since all the component members of the weft end treating device of the present invention are fixed, the weft end treating device is simple in construction, does not need any additional driving system, and can be applied to all kinds of shuttleless looms including jet looms and rapier looms. Still further, since no catch cord is necessary, the interruption of operation of the loom due to faulty picking attributable to the interference of vibrating catch cords with a picked weft, the miscutting of the free end of the weft, the excessive twisting of catch cords, and the interruption of operation of the loom due to the breakage of catch cords do not occur; consequently, the operating rate of the loom is improved and a constant tension is applied to inserted wefts to produce a fabric having an improved quality and not having any filling streaks.

A third embodiment, in which a weft detector is provided, will be illustrated hereinafter.

Figure 10:
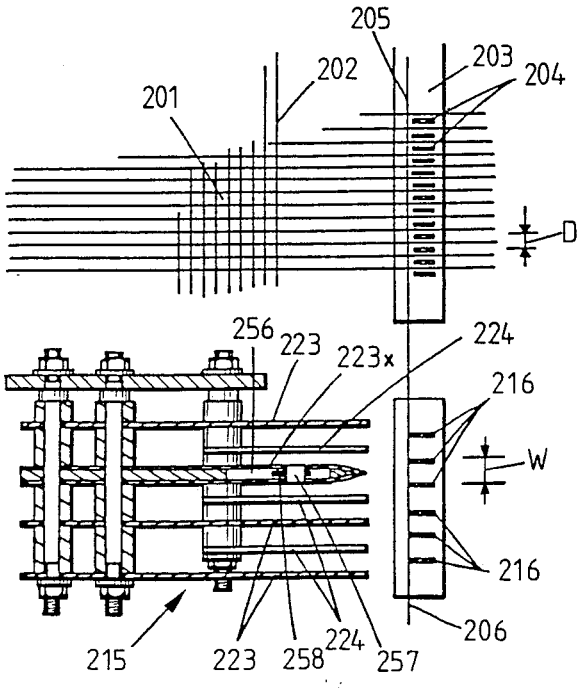
FIG. 10 is a sectional plan view taken on line 10—10 in FIG. 8.
Figure 11:
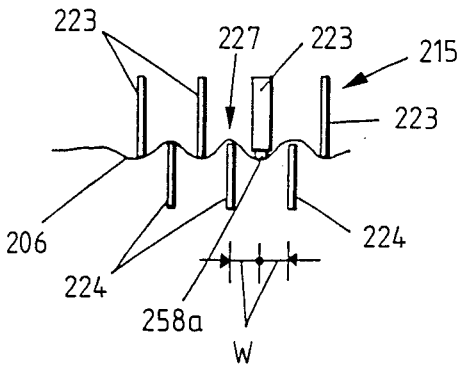
FIG. 11 is a front view of assistance in explaining a yarn holding action of a yarn holding device of FIG. 8.
Figure 12:
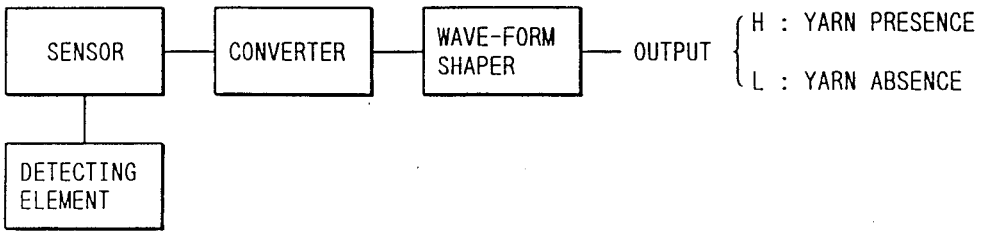
FIG. 12 is a block diagram of a signal processing unit.

FIGS. 8 to 13*a*–13*c* illustrate a weft detector in a third embodiment according to the present invention. In beating up an inserted weft, the extremity 206 of the weft is pushed into a yarn holding device 215 to tension the extremity 206 of the weft. A detecting element 258 is provided in the yarn holding device 215. Shown in FIG. 10 are a fabric 201, a cloth fell 202, a weaving reed 203 having dents 204, a weft 205 immediately after being inserted, and the extremity 206 of the weft 205.

Figure 8:
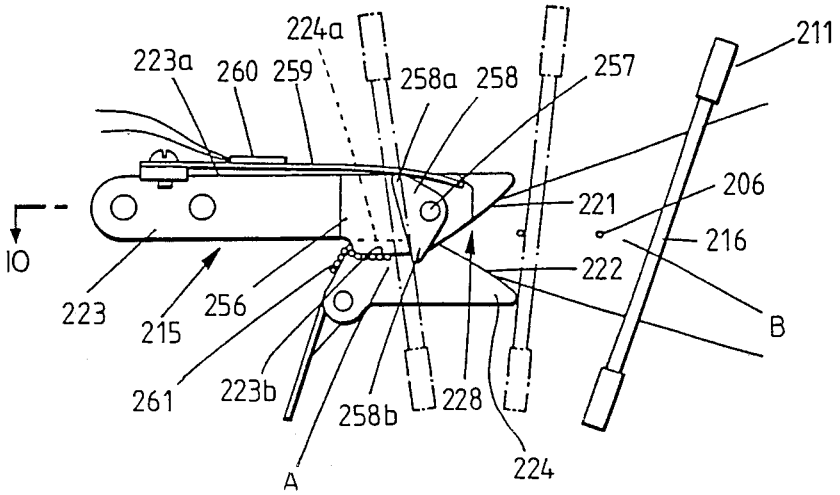
FIG. 8 is a side elevation of a first embodiment of a weft detector in a preferred embodiment according to the present invention in a standby state.
Figure 9:
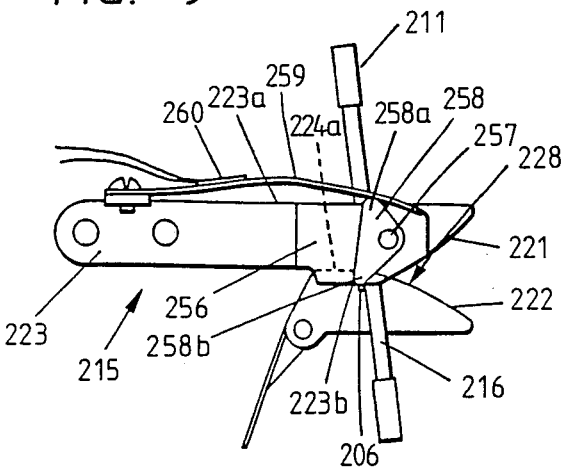
FIG. 9 is a side elevation of the weft detector of FIG. 8 in a state immediately before the completion of the beating motion of the loom.

The yarn holding device 215 comprises upper blades 223 and lower blades 224 which are arranged alternately so as to be positioned respectively opposite to spaces between the adjacent dents 216 of a detecting reed 211. Intervals W between the dents 216 of the detecting reed 16 are greater than intervals D between the dents 204 of the weaving reed 203. The lower edges 223*b* of the upper blades 223 and the upper edges 224*a* of the lower blades 224 overlap slightly each other and extend in parallel to a plane including the fabric 201. The rear portions 221, namely, portions near the detecting reed 211, of the lower edges 223*b* of the upper blade 223 are inclined upward and the rear portions 224*a*, namely, portions near the detecting reed 211, of the upper edges 224*a* of the lower blades 224 are inclined downward to form a guide section 228. The yarn holding device 215 is disposed on the side of the cloth fell 202 with respect to the running path B of the weft 205. In FIG. 8, indicated at A is an approximate position of the cloth fell 202. When the weft 205 is beaten by the weaving reed 211, the dents 216 of the detecting reed 211 push the extremity 206 of the weft through the guide section 228 into a zigzag path 227 defined by the lower edges 223*b* of the upper blade 223 and the upper edges 224*a* of the lower blade 224 to bend the extremity 206 of the weft 205 zigzag, so that the extremity 206 of the weft 205 is tensioned frictionally. Then, the extremity 206 of the weft 205 is cut off from the selvage of the fabric 201. The extremities 206 successively pushed into the yarn holding device 215 are pushed out sequentially from the front side, namely, a side remote from the detecting reed 211, of the yarn holding device 215.

The detecting cam 258 is disposed in a space between the opposite thin side walls of one upper blade 223*x* of the upper blades 223 and is held pivotally by a pin 257 on the upper blade 223*x*. The detecting cam 258 has a lower end 258*b* and an upper end 258*a*. In an ordinary state, the lower end 258*b* of the detecting cam 258 projects downward from the lower edge 223*b* of the upper blade 223*x*. When the lower end 258*b* of the detecting cam 258 is pushed to the front, namely, in the beating direction, the lower end 258*b* sinks into the space 256 and the upper end 258*a* projects from the upper edge 223*a* of the upper blade 223. A spring plate 259 is extended along the upper edge 223*a* of the upper blade 223*x* with the base end thereof fixed and the opposite extremity thereof in engagement with the upper blade 223*x*. A strain gauge 260 is attached to the spring plate 259.

The lower end 258*b* of the detecting cam 258 projects from the lower edge of the upper blade 223*x* between the guide section 228 of the yarn holding device 215 and a position corresponding to the position A of the cloth fell. When the inserted weft 205 is beaten, the extremity 206 of the weft 205 engages the lower end 258*b* of the detecting cam 258 as the extremity 206 is pushed deep into the yarn holding device 215 to turn the detecting cam temporarily, whereby the spring plate 259 is flexed. Upon the detection of the flexion of the spring plate 259, the strain gauge 260 provides a weft detection signal. When a weft is not inserted correctly, the extremity 206 of the weft is not pushed into the yarn holding device 215, and hence the detecting cam 258 is not turned. Consequently, the strain gauge 260 does not provide any weft detection signal.

The output signal of the strain gauge 260 is converted into a voltage signal by a converter (FIG. 12), such as a bridge circuit. FIG. 13*a* shows an exemplary waveform of the output signal of the converter. The waveform of the output signal of the converter is shaped in a waveform as shown in FIG. 13*b* by a simple waveform shaper, such as a slicer or a clamper. The output signal of the waveform shaper is HIGH when the weft 205 is inserted correctly, while the same is LOW when the weft 205 is not inserted correctly, namely, when the extremity 206 of the weft 205 does not reach a predetermined position corresponding to the detecting reed 211.

Thus, the weft detection signal provided by the strain gauge 260 is converted into a distinct pulse signal immediately before the completion of the beating operation, and hence the pulse signal can be discriminated precisely from noise signals attributable to the vibrations of the loom, because the spring plate 259 is flexed only for a very short time (the detecting cam 258 is pushed for turning motion only when the extremity 206 of the weft 205 passes the lower end 258*b* of the detecting cam 258 immediately before the completion of the beating operation), and the vibration of the spring plate 259 attenuates quickly since the spring plate 259 is held at the opposite ends thereof.

A weft detector in accordance with this embodiment of the present invention comprises a detecting reed 211 having dents 216 and disposed on the extension line of a weaving reed 203 on the weft arrival side of the loom at a position corresponding to a position where the extremity 206 of a normally inserted weft arrives, a detecting element 258 capable of entering a space between the adjacent dents of the detecting reed 211 and disposed opposite the detecting reed 211 on the side of the cloth fell 202 with respect to a running path B of a weft, and a sensor 260 for electrically detecting the motion of the detecting element 258.

When necessary, intervals W between the dents 216 of the detecting reed 211 may be greater than intervals D between the dents 204 of the weaving reed 203 to ensure the entrance of the detecting element 258 between the adjacent dents 216. If necessary, catch cords may be extended through a space between the adjacent dents 216.

The detecting reed 211 may be disposed near the selvage of a fabric 201 on the weft arriving side. The detecting reed 211 may be provided with several dents 216. The detecting element 258 is a thin or narrow member capable of passing through a space between the adjacent dents 216 and is supported with a pin or an elastic member so as to be movable when brought into contact with the extremity 206 of a weft. The sensor 260 is, for example, a strain gauge or a contactless sensor. The sensor 260 detects the motion of the detecting element 258 directly or indirectly through another member.

When a weft is inserted normally, the extremity 206 of the weft reaches a position opposite the detecting reed 211. When the weaving reed 203 advances for a beating motion, the detecting reed 211 advances together with the weaving reed 203 and the dents 216 of the detecting reed 211 push the extremity 206 of the weft, which in turn pushes the detecting element 258 temporarily. The extremity 206 of the weft leaves the detecting element 258 before being beaten to the cloth fell, so that the detecting element 258 is allowed to return to the original position. The sensor 260 provides a distinct pulse signal corresponding to the momentary movement of the detecting element. Since the detecting element 258 is separated apart from the path of the fluid jet and does not move together with the weaving reed 203, the pulse signal is scarcely disturbed by a disturbance and has a high SN ratio.

When a weft is inserted incorrectly, the extremity 206 of the weft is unable to reach the predetermined position opposite the detecting reed 211. Consequently, the detecting element 258 passes through the space between the adjacent dents 216 and is not moved at all when the weaving reed 203 advances for a beating motion. Consequently, the output signal of the sensor 260 remains unvaried, whereby faulty picking is detected.

When the extremity 206 of the weft is tensioned before the extremity 206 of the weft engages the detecting element 258 when the weft is beaten up, more precisely, during the beating operation, an increased pressure can be applied to the detecting element 258 by the extremity 206 of the weft and the position of the extremity 206 of the weft relative to the dents 216 of the detecting reed 211 can be fixed, so that a set quantity of interference of the extremity 206 of the weft with the detecting element 258 may be small, and hence the sensor 260 is able to provide an output signal having a large SN ratio.

Figure 16:
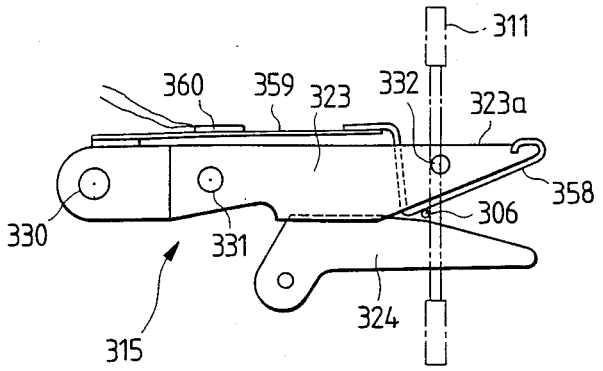
FIG. 16 is a side elevation of the weft detector of FIG. 14 in a state just before the completion of the beating motion of the loom.

Another embodiment of a weft detector will be illustrated referring to FIGS. 14, 15 and 16. In this embodiment, a spring is used as a detecting element 358 in spite of the detecting cam which is used in the third embodiment. The yarn holding device 315 comprises upper blades 323 and lower blades 324 which are arranged alternately. The lower edges **323*b* of the upper blades 323 and the upper edges 324*a* of the lower blades 324 overlap slightly each other so that a guide section 328 of the yarn holding device 315 is defined between the lower edges 323*b* and the upper edges 324*a*. One of the upper blades 323 comprises two thin plates which are arranged in parallel relationship with a slight space and are fixed by pins 330, 331 and 332. A spring plate 359 is extended along the upper edge 323*a* of the upper blade 323 with the base end thereof fixed to the upper blade 323. A strain gauge 360 is attached to the spring plate 359. A spring of the detecting element is inserted within the space of the two plates of the upper blades 323. An end of the detecting element 358 is fixed at an extremity of the upper edge 323*a* of the upper blade 323. The detecting element 358 projects from the lower edge 323*b* of the upper blade 323 toward the guide section 328 in a standby state and is bent to be extended and to be fixed on a free end of the spring plate 359 at the another end thereof. Accordingly, when the inserted weft 305 is beaten, the extramity 306 of the weft 305 is pushed into the guide section 328 of the yarn holding device 315 by the detecting reed 311, and comes into contact with the detecting element 358 to push up the detecting element 358, whereby the spring plate 359 is flexed and moved from the upper edge 323*a* of the upper blade 323. Upon the detection of the flexing of the spring plate 359, the strain gauge 360 provides a weft detection signal, that is, signal that a weft 306 is inserted into the yarn holding device 315** correctly.

Figure 17A:
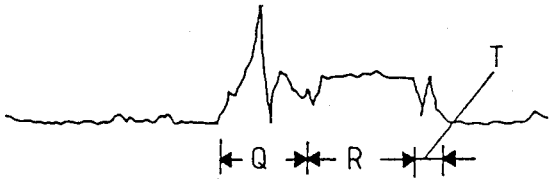
FIGS. 17*a*, 17*b* and 17*c* are waveform charts showing the waveforms of signals corresponding to those of FIGS. 13*a*, 13*b* and 13*c*, used by a conventional electrical weft detector of a conduction type.
Figure 17B:
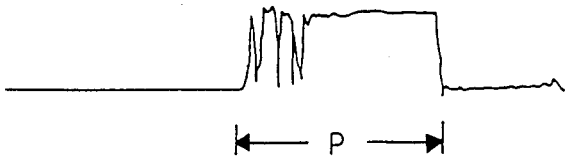
Figure 17C:
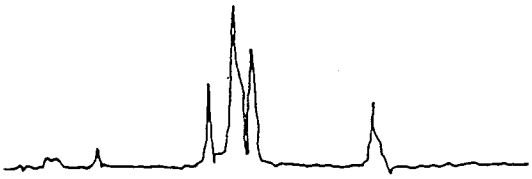
Figure 18:
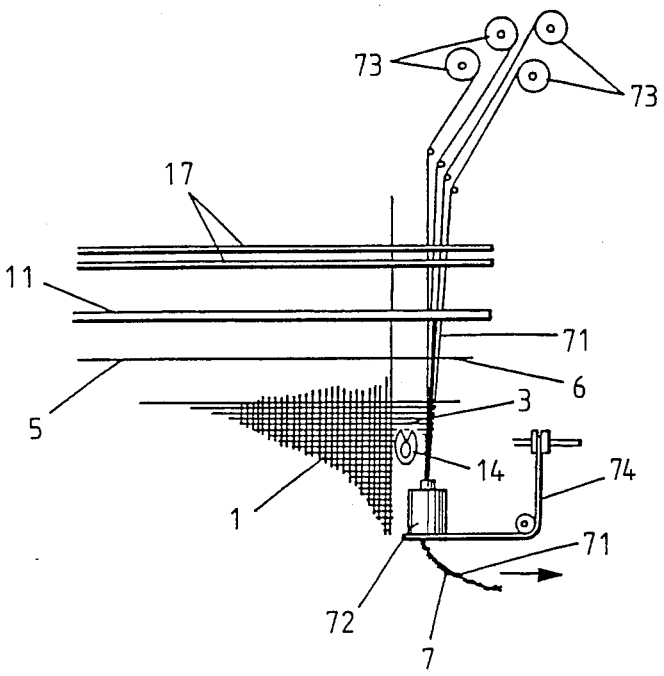
FIG. 18 PRIOR ART
FIG. 18 is a plan view of a conventional weft end treating device.

FIGS. **13*a*–13*c* and 17*a*–17*c* comparatively show weft detection signals provided by the weft detector in the foregoing embodiments and the conventional electrical weft detector of a conduction type. FIGS. 13*a*–13*c* show the output signals in the weft detector of the present invention, and FIGS. 17*a*–17*c* show the output signals in the conventional electrical weft detector of a conduction type. FIGS. 13*a* and 17*a***, (*a*) show an original weft detection signal, FIGS. **13*b* and 17*b* show a signal obtained by shaping the waveform of the original weft detection signal and FIGS. 13*c* and 17*c* show a signal when a weft is not inserted correctly. First, the electrical weft detector of a conduction type detects a fluid jet (a period Q), detects a weft (a period R), and then detects catch codes (a period T). Since the sensor of the electrical weft detector of a conduction type provides pulses corresponding to the fluid jet and the catch codes even if a weft is not inserted correctly, a decision whether or not a weft is inserted correctly must be made on the basis of the magnitude of the pulse width P of the output signal of the waveform shaper. Therefore, it is possible that erroneous weft detection occurs depending on the mode of the fluid jet and that of contact of the weft with the electrodes. On the other hand, the weft detector of the present invention provides a distinct pulse signal as shown in FIGS. 13*a* and 13*c*** only when a weft is detected and does not provide any pulse signal when any weft is not detected. Thus, the weft detector of the present invention provides a weft detection signal having a very high SN ratio and is capable of stably detecting whether or not a weft is inserted correctly without being affected by disturbances.

Furthermore, the weft detector of the present invention is applicable to shuttleless looms of every kind since the weft detector of the present invention does not utilize the electrical properties of the picking fluid is applicable to high-speed looms since the response speed of the detecting element is high, does not flaw the fabric since the detecting element does not interfere with the fabric, and requires a electric unit including a simple waveform shaper since the weft detection signal is a distinct pulse signal unaffected by disturbances.

What is claimed is:

1. A weft end treating device for a shuttleless loom including a tension apply means which comprises a yarn holding device fixedly mounted on a frame of the loom outside the selvage of a fabric on the loom on the weft arriving side of the loom, and pushing dents disposed opposite to the yarn holding device, said yarn holding device comprising a plurality of weft end bending members forming a weft guide space and arranged by a supporting means in a zigzag relationship to form a zigzag path, so that extremity of an inserted weft is pushed into the zigzag path through the weft guide space by means of the pushing dents, said weft end bending members each comprising an upper blade and a lower blade which have inclined edges at one end and are arranged by a supporting means alternately with the lower edge of the upper blade and the upper edge of the lower blade slightly overlapping each other so as to form the zigzag path therebetween and to form a guide space.

2. The weft end treating device as claimed in claim 1, wherein a discharge guide is provided with the lower blade extending downwardly and remote from the pushing dent.

3. The weft end treating device as claim in claim 1, wherein said upper blades and lower blades are spaced apart from each other with spacers and are fixed on a support plate, respectively, which is adjustably located relative to the selvage in the direction of width of the fabric along a temple bar.

4. The weft end treating device as claimed in claim 1, wherein said pushing dents have a plurality of dents which are fixed at the respective ends thereof dimensioned to enter spaces between the alternately arranged upper blades and the lower blades, respectively.

5. A weft end treating device for a shuttleless loom including a tension apply means which comprises a yarn holding device fixedly mounted on a frame of the loom outside the selvage of a fabric on the loom on the weft arriving side of the loom, and pushing dents disposed opposite to the yarn holding device, said yarn holding device comprising a plurality of weft end bending members forming a weft guide space and arranged by a supporting means in a zigzag relationship to form a zigzag path, so that extremity of an inserted weft is pushed into the zigzag path through the weft guide space by means of the pushing dents, said weft end bending member comprising upper wires and lower wires which are arranged alternately respectively with spacers and one end of which is extended behind the dents, said upper wires and lower wires positioned in overlapping relation to each other to define a zigzag path, in which a free end of a web is bent in a zigzag shape.

6. A weft end treating device for a shuttleless loom including a tension apply means which comprises a yarn holding device fixedly mounted on a frame of the loom outside the selvage of a fabric on the loom on the weft arriving side of the loom, and pushing dents disposed opposite to the yarn holding device, said yarn holding device comprising a plurality of weft end bending members forming a weft guide space and arranged by a supporting means in a zigzag relationship to form a zigzag path, so that extremity of an inserted weft is pushed into the zigzag path through the weft guide space by means of the pushing dents, and a detecting element dimensioned to enter a space between adjacent dents of a detecting reed is disposed on the side of a cloth fell with respect to a picking path and a detecting means for electrically detecting the motion of the detecting element is provided.

7. The weft end treating device as claimed in claim 6, wherein said detecting element is a detecting cam which is held pivotally by a pin on one of the weft end bending members and said detecting means comprises a spring plate extended along the ending member and positioned to be contacted by the detecting cam, and a strain gauge attached to the spring plate so that when the inserted weft is beaten, the weft engages an end of the detecting cam to turn the detecting cam temporarily and to flex the spring plate, and then the strain gauge provides a weft detection signal.

8. The weft end treating device as claimed in claim 6, wherein one of said weft end bending members comprises spaced thin plate members and said detecting element comprises a spring which is bent and inserted between said thin plate members, and said detecting means comprises a spring plate extended along the edges of the said weft end bending member, and a strain gauge attached to the spring plate, said bent spring being fixed on the spring plate at one end thereof so that when the inserted weft is beaten, the weft pushes the bent spring to flex the spring plate, and then the strain gauge provides a weft detection signal.

9. A weft detector for a shuttleless loom comprising a detecting reed disposed in alignment with the extension line of a weaving reed on the weft arrival side of the loom, and a detecting element disposed on one side of the cloth fell dimensioned to enter a space between the adjacent dents of the detecting reed, and a sensor for electrically detecting the motion of the detecting element when it enters said space.

10. A weft detector according to claim 9, further comprising a tensioning means for applying a tension to the free end of a normally inserted weft during the beating motion of the loom.

* * * * *